US007757900B2

(12) United States Patent
Knauer et al.

(10) Patent No.: US 7,757,900 B2
(45) Date of Patent: Jul. 20, 2010

(54) DISPENSER PUMP

(75) Inventors: Roland Knauer, Sonneberg (DE); Frank Rauch, Stockheim (DE); Stephan Porzelt, Kronach (DE); Hans-Joachim Ahrens, Wernigerode (DE); Barbara Kösske, Marktrodach (DE); Wolfgang Heukamp, Finnentrop (DE)

(73) Assignee: RPC Wiko GmbH, Pulheim (DE)

( * ) Notice: Subject to any disclaimer, the term of this patent is extended or adjusted under 35 U.S.C. 154(b) by 813 days.

(21) Appl. No.: 10/578,202

(22) PCT Filed: Nov. 4, 2003

(86) PCT No.: PCT/EP03/12267

§ 371 (c)(1),
(2), (4) Date: Jan. 16, 2007

(87) PCT Pub. No.: WO2005/051771

PCT Pub. Date: Jun. 9, 2005

(65) Prior Publication Data

US 2007/0138209 A1 Jun. 21, 2007

(51) Int. Cl.
*B65D 37/00* (2006.01)

(52) U.S. Cl. ..... 222/207; 222/211; 222/212; 222/383.1

(58) Field of Classification Search ..... 222/207, 222/209, 211–212, 215, 383, 386–387, 383.1
See application file for complete search history.

(56) References Cited

U.S. PATENT DOCUMENTS 2,690,278 A * 9/1954 Flavius ..... 222/207
3,130,877 A * 4/1964 Miller ..... 222/207
3,162,334 A 12/1964 Miller
3,753,518 A * 8/1973 Kutik ..... 222/383.1
4,174,069 A * 11/1979 Grogan ..... 239/333
4,396,132 A * 8/1983 Christensen ..... 222/1
4,429,813 A * 2/1984 De Freitas ..... 222/207
4,512,246 A * 4/1985 Chappell et al. ..... 99/312
4,564,130 A * 1/1986 Eulenburg ..... 222/207

(Continued)

FOREIGN PATENT DOCUMENTS

DE 35 07 355 8/1990

(Continued)

*Primary Examiner*—Kevin P Shaver
*Assistant Examiner*—Andrew P Bainbridge
(74) *Attorney, Agent, or Firm*—Friedrich Kueffner

(57) ABSTRACT

The invention relates to a dispenser pump (1), for the non-dropping, dosed dispensing of liquid to pasty products from containers, for example, from bottles, canisters, or tubes, comprising a pump lower section (6) with a suction opening (4) and a pump upper section (8) with a moving lid (10), for sucking up the product through the suction opening (4) of the pump lower section (6) into a suction chamber (14) and to dispense the product from said suction chamber (14), through a dispensing channel (3) with an application opening (24). According to the invention, a constructive simplification may be achieved, whereby the lower end of the suction chamber (14), arranged beneath the lid (10), is embodied by a floating elastic disc valve (7) which, on alternate axial displacement of the lid (10), opens and closes the lower opening (2) of the dispensing channel section (3'), due to arching of the mid-section thereof and conversely, by deformation of the outer boundary region (25) thereof, opens and closes the suction opening (4) of the pump lower section (6).

14 Claims, 6 Drawing Sheets

U.S. PATENT DOCUMENTS 5,544,789 A * 8/1996 Gillingham ..... 222/153.13
5,884,820 A 3/1999 Thanisch et al.

FOREIGN PATENT DOCUMENTS

DE 38 37 704 3/1994
DE 198 16 399 10/1999
DE 102 22 652 12/2003
EP 0 810 160 12/1997
GB 2 157 372 10/1985
WO 01/91911 12/2001

* cited by examiner

DISPENSER PUMP

The invention pertains to a dispenser pump for the drip-free dispensing of metered amounts of liquid to paste-like products from containers such as bottles, canisters, or tubes, consisting of a lower pump part, which is equipped with a suction opening and is designed to be fastened in the opening of a container, where the suction opening is brought into contact with the product by means of, for example, a tube; and an upper pump part, which has a movable hood and is designed to draw the product through the suction opening of the lower pump part into a suction chamber and to discharge the product from this suction chamber through a discharge channel with an applicator opening.

For the metered discharge of liquid to paste-like products, various devices are known which can be used to remove the product from the storage container and convey it through an applicator opening. The design and function of these devices differ fundamentally from each other.

DE 35 07 355 C2 describes a paste dispenser with a hollow cylindrical dispenser housing, which is open to the atmosphere at its lower end and sealed by a follower piston. At the upper end, a pump piston with a tubular piston rod is provided, the piston being free to slide in the axial direction. The upper pump piston and the lower follower piston form the boundaries of a paste chamber. To dispense a metered amount of the paste, a downward-directed pressure is exerted externally on the upper pump piston to force paste through the hollow piston rod to the applicator opening. After the pump piston has been returned to its original position by the force of a spring, the vacuum produced in the paste chamber draws the follower piston back upward. This process can be repeated until the paste chamber is empty and the follower piston has come in contact with the pump piston.

DE 38 37 704 C2 describes a dispenser for paste-like products with a metering pump for discharging metered amounts from bottle-like or can-like paste containers. The dispenser has a folding bellows of an elastic, rubber-like plastic, which is installed as a connection between the two housing parts of dimensionally stable plastic, which telescope axially into each other. The housing parts are free to move axially with respect to each other between two end positions and are equipped with restoring springs. To dispense the paste, pressure is applied externally to the housing parts to push them down, as a result of which the paste inside the folding bellows is pushed through the housing parts to the applicator opening. When the external pressure is released, the housing parts are returned to their original positions by the elastic force of the folding bellows. The return movement opens a valve in the lower opening of the folding bellows and refills the bellows, and simultaneously additional paste is pulled upward in this case as well by a follower piston.

Dispensers are also known which have a dispenser pump installed in a dispenser head, where the pump chamber of the dispenser pump has nonreturn valves on the inlet and outlet sides. An axially movable thrust piston is installed inside the pump chamber sealed off in this way. The piston can be pushed down by externally applied force, and after the external force has been released, the piston is restored to its original position by the restoring springs installed in the pump chamber.

Common to all the dispensers indicated above is that a dispenser head is provided with a dispenser pump, which, when actuated by the application of external force, conveys the product via a pump chamber through an applicator opening.

The invention is based on the task of improving a dispenser pump of the type described above in such a way that a product can be dispensed reliably in precisely metered amounts by a dispenser which is easy to operate, simple in design, and inexpensive to manufacture.

The task is accomplished by the characterizing features of claim 1 in that the bottom end of the suction chamber is designed as a "floating" elastic valve disk with a central disk area which, when the pressure inside the suction chamber changes as a result of the movable hood, alternately bulges up and down to open and close the centrally located bottom opening of the discharge channel part, whereas conversely the outer edge area of the disk undergoes deformation simultaneously to close and open the suction opening of the lower pump part.

The elastic valve disk with this double function is manufactured out of a thermoplastic elastomer or out of rubber and can be designed according to the invention with bellows-like corrugations in its outer area.

According to the invention, the bottom opening of the lower discharge channel part extends all the way down to the center of the valve disk, so that, when the pump is in the starting position, the bottom opening is closed from underneath by the center part of the valve disk. Simultaneously, the top of the larger suction opening of the lower pump part is closed off by the outer edge area of the valve disk when the pump is in the starting position. By applying force externally to the hood and thus displacing the hood axially toward the valve disk, the volume of the suction chamber is decreased, and the internal pressure in the suction chamber is increased. The center part of the valve disk bulges downward under the action of this positive pressure and thus frees the bottom opening of the discharge channel. Simultaneously, the positive pressure presses the outer edge area of the valve disk firmly onto the correspondingly shaped suction opening of the lower pump part, so that this continues to be sealed. As a result of the positive pressure in the suction chamber and the freeing of the bottom opening of the discharge channel, the product to be dispensed is forced out of the suction chamber and conveyed through the discharge channel, including the upper discharge channel part, which includes an angled section, and out through the applicator opening, which extends laterally outward from the upper pump part.

As a result of the return of the hood to the starting position after the completion of the dispensing process and the associated increase in the volume of the suction chamber, the internal pressure in the suction chamber decreases. The negative pressure thus produced draws the "floating" elastic valve disk upward. The center part of the valve disk thus tightly seals the bottom opening of the discharge channel again. Because none of the components of the dispenser pump limits its upward travel, the outer edge area of the valve disk follows this suction movement upward and thus frees the suction opening of the lower pump part, so that the suction chamber can be filled with fresh product again.

According to an advantageous embodiment of the invention, the hood is made out of an elastic material such as a thermoplastic elastomer, so that it can undergo axial deformation. It is fastened and sealed to an upper edge of the upper pump part, above the upper angled discharge channel part. The entire discharge channel is formed here as a stationary discharge tube, molded into the upper pump part, and the upper pump part is permanently connected to the lower pump part.

External force applied to the elastic hood causes the hood to be axially deformed and decreases its volume. As a result, as previously described, the pressure in the suction chamber underneath the hood is increased, and the dispensing process takes place as described. A stop, located above the angled discharge channel part on the upper inside surface of the hood, limits the axial displacement of the hood toward the angled discharge channel part. Upon completion of the dispensing process, the hood returns to its original position exclusively as a result of its own elastic restoring forces, and the suction chamber becomes filled again with product.

The hood is made of an elastic and thus soft material. To protect it from damage, an axially movable safety cap is mounted on the upper pump part, so that the external force can be exerted on this cap and thus introduced indirectly to the hood.

In another embodiment of the invention, the sensitive hood is protected by a swinging cover, which is hinged to the upper pump part. When the dispensing pump is not being used, the swinging cover lies over the hood and protects it.

In accordance with another embodiment of the inventive dispensing pump, the upper pump part is free to move axially with respect to the lower pump part, so that the upper discharge channel part and the hood, both of which are parts of the upper pump part, are also able to move axially. The lower discharge channel part is permanently connected to the lower pump part and thus stationary. The suction chamber is designed as an annular space with a ring-shaped piston in the manner of a piston pump, where the annular space forms a circular ring which surrounds the lower discharge channel part and thus forms a stationary part of the lower pump part. The ring piston of this pump-like suction chamber surrounds, and is permanently connected to, the upper discharge channel part and is thus free to move axially along with it and thus with the hood.

During the dispensing process, force applied externally to the hood pushes the entire upper pump part along with the ring piston toward the valve disk. The pressure inside the suction chamber thus increases, and the dispensing process proceeds as described above. The hood itself, however, no longer consists of elastic material which can be deformed by the external force. It is instead part of the rigid upper pump part. A restoring spring, which is supported against the lower pump part, is therefore provided inside the upper pump part to return the upper pump part to its starting position after completion of the dispensing process. The restoring spring can be located inside the discharge channel or outside both the discharge channel and the suction chamber.

Additional advantages, features, and properties of the invention are explained in greater detail below on the basis of the exemplary embodiments, which are illustrated in the figures. For the sake of clarity, the same design components are designated by the same reference numbers:

Figure 1:
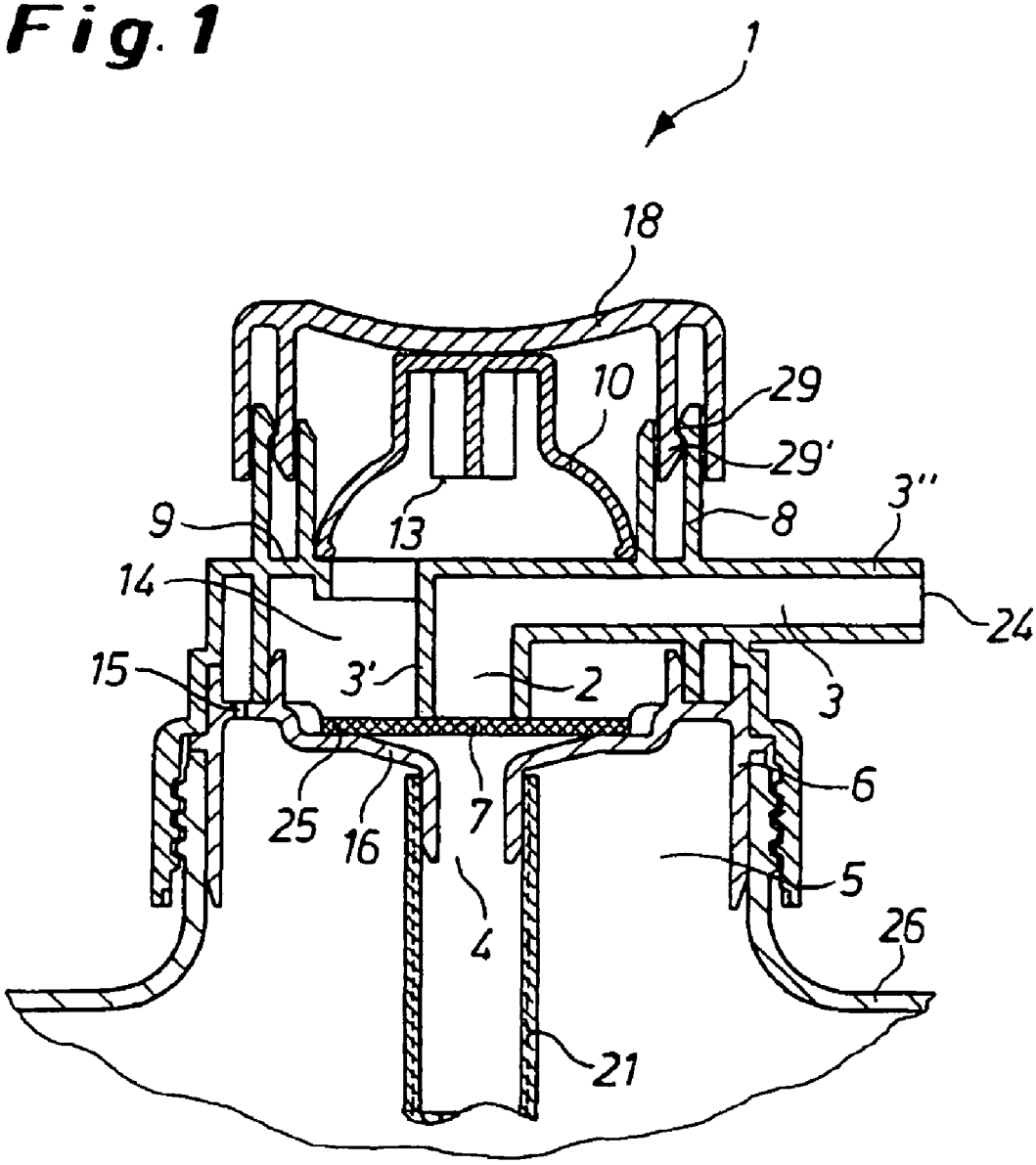
FIG. 1 shows a vertical cross section through a dispenser pump.

FIG. 1 shows a vertical cross section through an inventive dispenser pump 1, which consists of an upper pump part 8 and a lower pump part 6. The lower pump part 6 is pressed into the container opening 5 of a bottle 26 (only the neck of which is shown) to form a seal, whereas the upper pump part 8 is screwed onto the neck of the bottle. The suction opening 4 of the lower pump part 6, which projects into the container opening 5 from above, is designed as a funnel 16 with a connecting piece for the attachment of a tube 21, which is immersed in the product in the bottle 26 (the product itself is not shown). To seal off the suction opening 4, a valve disk 7 rests on the funnel 16 of the lower pump part 6. The outer edge area 25 of this valve disk, in the starting position shown, tightly seals the suction opening 4.

Above the valve disk 7 there is a suction chamber 14, limited by the valve disk 7 and a deformable hood 10. The suction chamber is in working connection with the hood 10. The bottom opening 2 of the discharge channel part 3' extends all the way down to the center of the valve disk 7. In the starting position shown here, the valve disk 7 thus seals off this bottom opening also. The elastically deformable hood 10 is attached and sealed to an upper edge 9 of the upper pump part 8, above the upper discharge channel part 3", which includes an angled section and the applicator opening 24. The hood 10 is provided on the inside with a stop 13 at the top end. When the stop makes contact with the discharge channel part 3", it prevents any further axial displacement (deformation) of the hood.

When the hood 10 is pushed toward the valve disk 7, positive pressure builds up in the suction chamber 14. This causes the valve disk 7 to deflect downward until it rests against the funnel 16 of the lower pump part 6. As a result, the bottom opening 2 of the discharge channel part 3' is freed, and the product which has collected in the suction chamber 14 is ejected through the discharge channel part 3".

When the hood 10 returns to its starting position, negative pressure develops in the suction chamber 14. This negative pressure has the effect of pulling the outer edge area 25 of the valve disk 7 up and away from the funnel 16—the center part of the valve disk 7 being held in position by the lower discharge channel part 3'—as a result of which the valve disk 7 frees the suction opening 4. Product is thus drawn up from the container 26 via the tube 21 into the suction chamber 14. A lower air hole 15 is provided laterally on the upper pump part 8 to allow the pressure to equalize after the product has been dispensed from the container 26.

To protect the deformable and therefore soft hood 10 against damage, an axially movable safety cap 18 is mounted on the upper pump part 8. Pushing this cap down thus indirectly pushes the hood 10 down as well. Ring beads 29, 29' retain the safety cap 18 and guide it as it slides up and down in the upper pump part 8.

Figure 2:
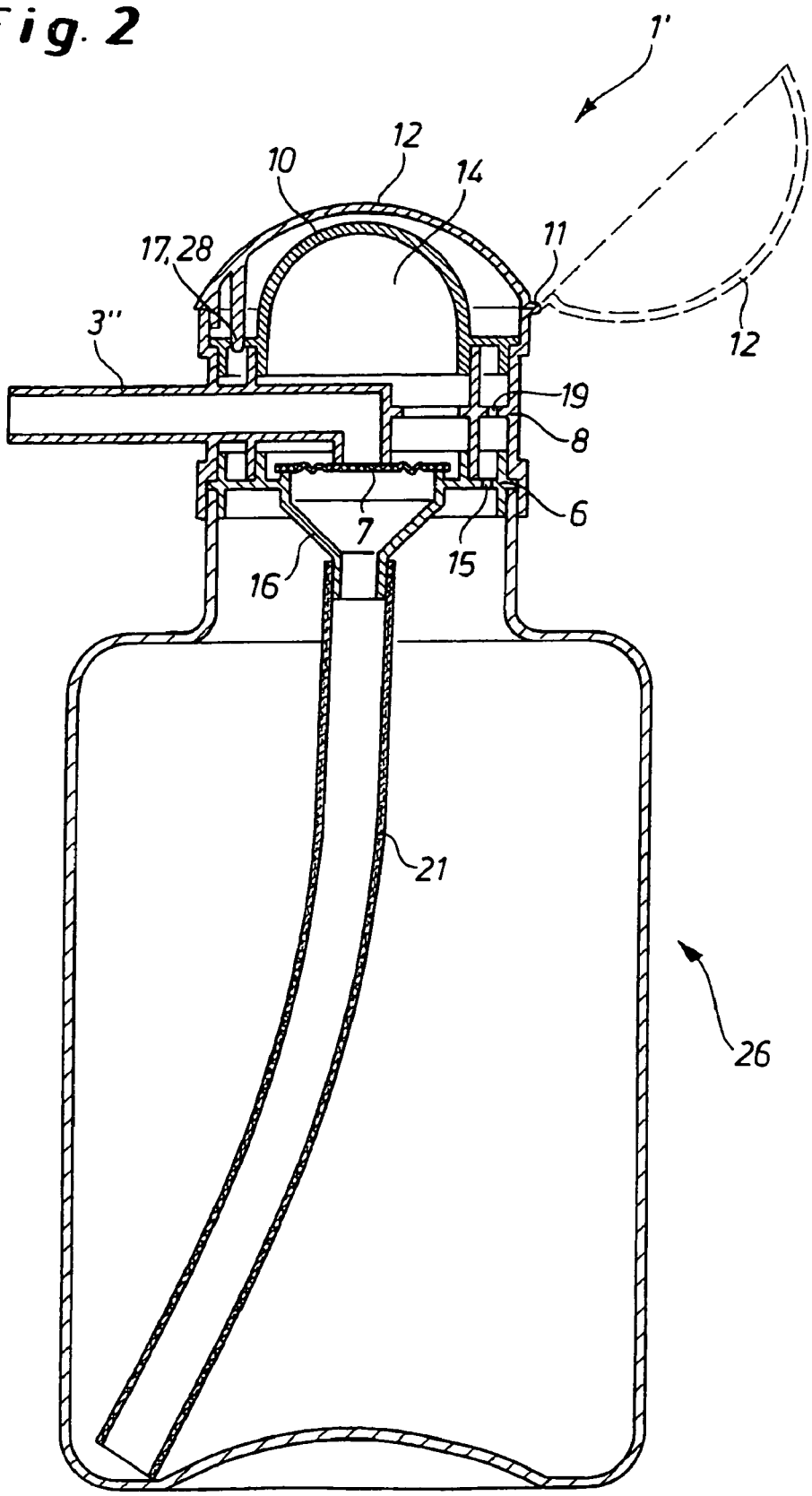
FIG. 2 shows a vertical cross section of a second dispenser pump on a bottle.
Figure 3:
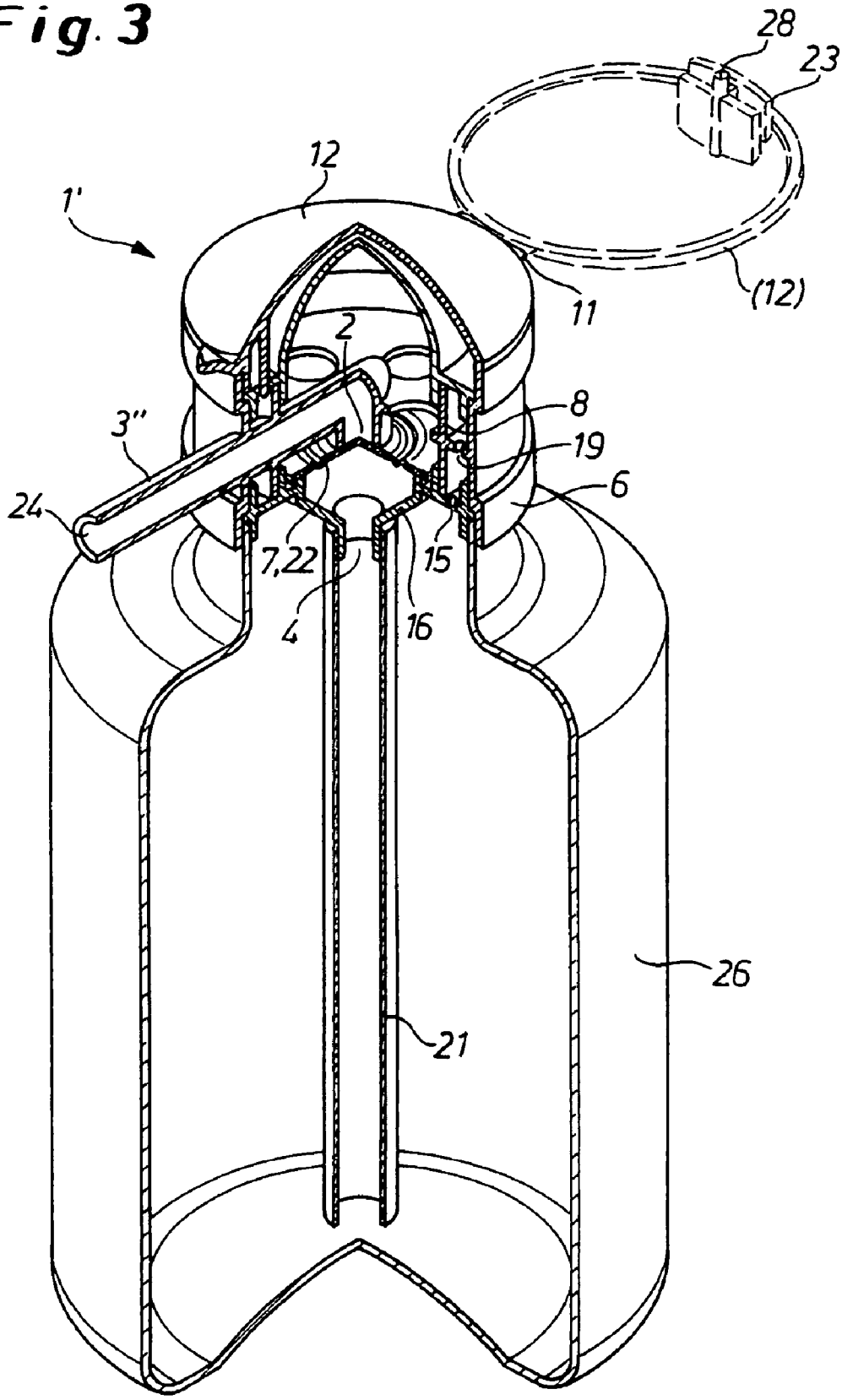
FIG. 3 shows a partial cross-sectional perspective view of the dispenser pump of FIG. 2.

FIGS. 2 and 3 show a similar (second) embodiment of the inventive dispenser pump 1'. In comparison with the dispenser pump 1 of the FIG. 1, the hood 10 of the dispenser pump 1' is not protected by an axially sliding safety cap but rather by a swinging cover 12, which is connected by a hinge 11 to the upper pump part 8. Opposite the hinge 11, a latch 23 is provided on the swinging cover 12; this latch locks onto the upper edge of the upper pump part 8 when the swinging cover 12 is closed.

As shown in FIG. 2, an upper air hole 17 is provided for pressure equalization laterally in the upper pump part 8, outside the suction chamber 14. For safety during transport, this hole is sealed by a sealing pin 28 in the swinging cover 12.

As can be seen in FIG. 3, additional air holes 19 are provided in the upper pump part 8, which allow the lower air hole 15 (see FIG. 1) to communicate with the upper air hole 17 (see FIG. 2). In addition, FIG. 3 shows that the outer edge area 25 of the elastic valve disk 7 is designed with bellows-like corrugations 22, which make it easier for the outer edge area 25 to move up and down and also improve the centering of the "floating" valve disk 7.

Figure 4:
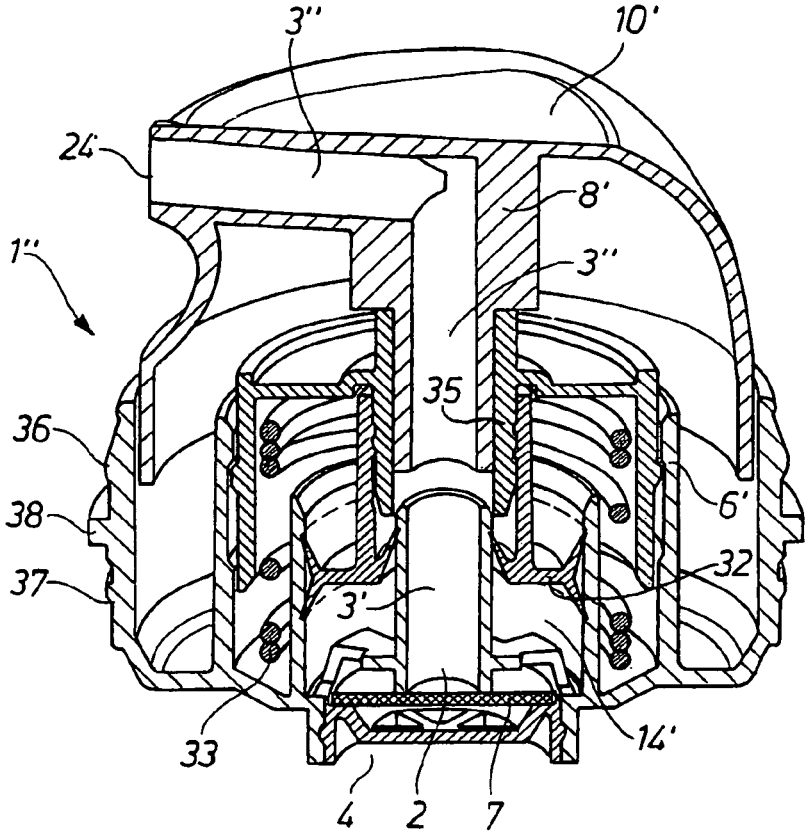
FIG. 4 shows a partial cross-sectional perspective view of a third dispenser pump.
Figure 5:
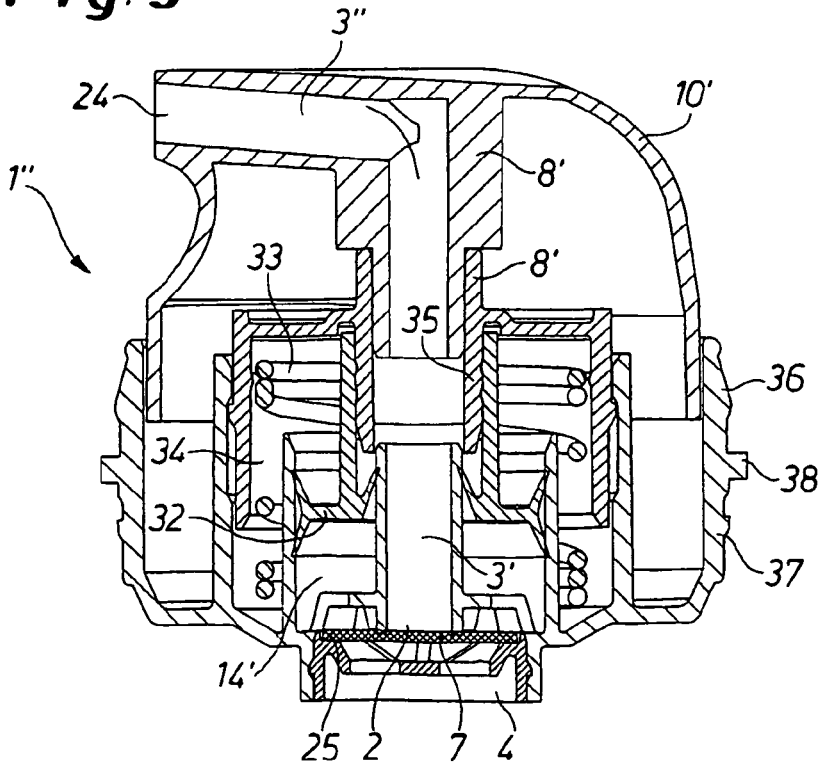
FIG. 5 shows a vertical cross section through the dispenser pump of FIG. 4.

FIGS. 4 and 5 show a perspective partial cross section (FIG. 4) and a vertical cross section (FIG. 5) of another (third) embodiment of the inventive dispenser pump 1". In contrast to the dispenser pumps 1 and 1' of FIGS. 1-3 with a permanent connection between the two dispenser pump parts 6, 8 via the container 26, the upper pump part 8' of the dispenser pump 1" shown here is free to move axially in the lower pump part 6', where the lower pump part 6' surrounds the lower area of the upper pump part 8'. When the upper pump part 8' is pushed down, the upper discharge channel part 3" and the hood 10', both of which are components of the upper pump part 8', are also pushed down in the same way. The lower pump part 6' and its lower discharge channel part 3' are incapable of movement and during use are permanently connected to the container (the container is not shown). The two discharge channel parts 3' and 3" are a certain distance away from each other, the gap between them being bridged by an intermediate collar 35, which is free to slide over the lower discharge channel part 3'.

Whereas, in the case of dispenser pumps 1, 1', the internal pressure in the suction chamber 14 is changed by a deformable elastic hood 10, this internal pressure in the case of the dispenser pump 1" is changed by a ring piston 32. For this purpose, the suction chamber 14' is designed as a stationary annular space in the manner of a piston pump and surrounds in circular fashion the lower discharge channel part 3'. The lower closure of the suction chamber 14' is formed, as in the previous embodiments, by the valve disk 7, whereas the upper closure is provided by the ring piston 32, which surrounds in circular fashion the upper discharge channel part 3" and the intermediate collar 35, to which it is permanently connected, but is free to shift position axially, sliding together with the upper discharge channel part over the lower discharge channel part 3'.

As a result of the design of the suction chamber 14' with a ring piston 32, which is connected to the hood 10' and to the discharge channel part 3" and which thus moves axially along with them, a direct action different from that of the dispenser pumps 1, 1' of FIGS. 1-3 is obtained. When the hood 10' shifts axially downward under the effect of external force, the ring piston 32 is also pushed axially downward. The internal pressure in the suction chamber 14' increases, and the center of the valve disk 7 frees the bottom opening 2 of the discharge channel part 3' located directly above it in the manner previously described. The product is now discharged from the suction chamber 14', passing through the discharge channel 3 and leaving through the applicator opening 24.

Upon completion of the dispensing process, the return of the hood 10' causes a negative pressure to develop in the suction chamber 14', which, here again, causes the outer edge area of the valve disk 7 to arch upward, thus freeing the suction opening 4 and allowing fresh product to be drawn into the suction chamber 14'. The return of the hood 10' proceeds positively under the action of a restoring spring 33, which is mounted in a closed annular space 34 outside the discharge channel 3 and the suction chamber 14' and which supports the upper pump part 8' against the lower pump part 6'.

Figure 6:
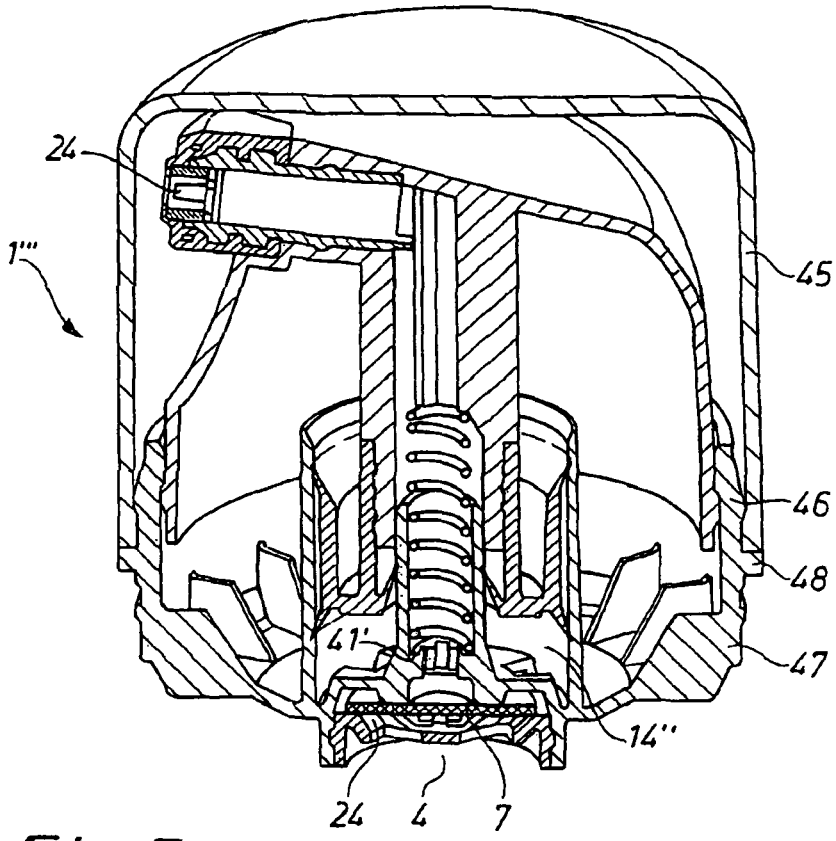
FIG. 6 shows a partial cross-sectional perspective view of a fourth dispenser pump.

The outside wall of the lower pump part 6' is designed with an upper profiling 36 for the attachment of a safety cap 45 (FIG. 6). Separated from the upper profiling by a ring-shaped web 38, a lower profiling 37 is also provided on the outside wall, so that the lower pump part 6' can be pressed tightly into a container opening.

Figure 7:
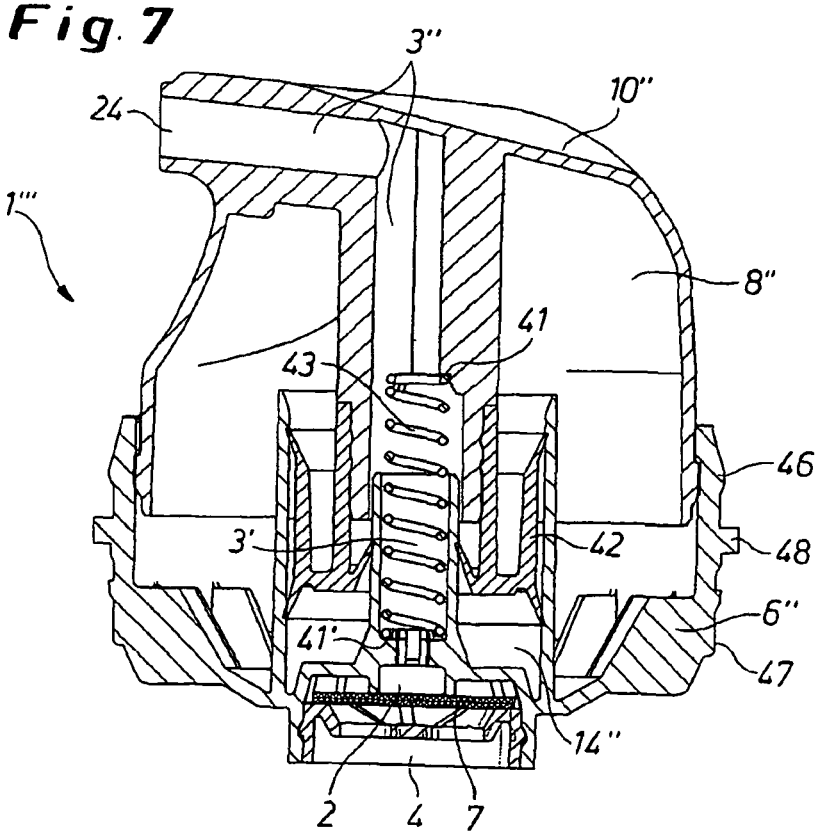
FIG. 7 shows a vertical cross section through the dispenser pump of FIG. 6.

FIGS. 6 and 7 show a perspective partial cross section (FIG. 6) and a vertical cross section (FIG. 7) of an additional (fourth) dispenser pump 1'", which operates according to the same principle as the dispenser pump 1" of FIGS. 4 and 5. This fourth pump is characterized above all by a design which is simpler than that of dispenser pump 1". Thus, the restoring spring 43 for returning the container hood 10" is no longer located in a closed annular space outside the suction chamber 14" and outside the discharge channel 3 but rather inside the discharge channel 3. The upper end of the restoring spring 43 is supported against an inner edge 41 inside the upper discharge channel part 3", whereas the lower end is supported against a corresponding inner edge 41' at the lower end of the lower discharge channel part 3'. An intermediate collar for connecting the two discharge channel parts to each other is no longer present in this exemplary embodiment, because the lower end of the upper discharge channel part 3" is pushed directly over the lower discharge channel part 3' with freedom to slide, so that here the ring piston 42 is connected directly to the upper discharge channel part 3".

With a design otherwise similar to that of dispenser pump 1" with an upper pump part 8" which can be pushed axially into the lower pump part 6", as a result of which the components of the upper pump part (hood 10", discharge channel part 3", and ring piston 42) are also able to shift axially with respect to the components of the lower pump part 6" (suction chamber 14", discharge channel lower part 3, valve disk 7), the dispenser pump 1'" can be manufactured more easily as a result of the omission of the intermediate collar and the annular space for the restoring spring and thus can be provided with more slender external dimensions, which is, of course, advantageous.

FIG. 6 shows the dispenser pump 1'" with a safety hood 45, which fits onto the upper profiling 46 of the outer wall up as far as the ring-shaped web 48. Here, too, a lower profiling 47 is formed on the outside wall so that the lower pump part 6" can be introduced into a container opening with a sealing effect.

Figure 8:
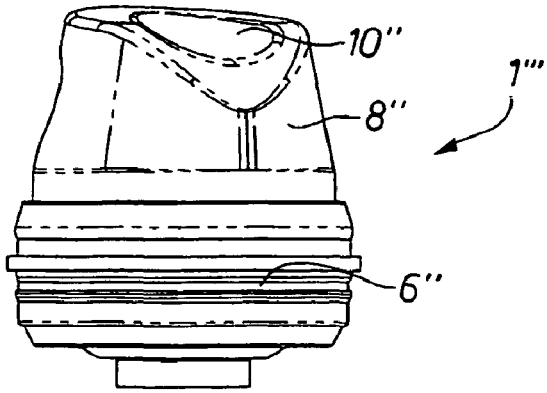
FIGS. 8-10 show various views of the dispenser pump of FIG. 7.
Figure 9:
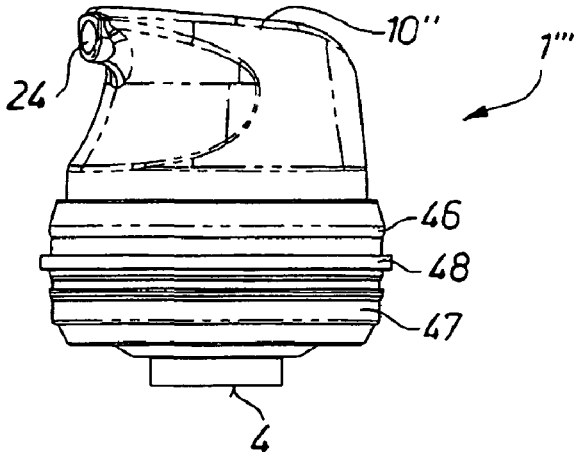
Figure 10:
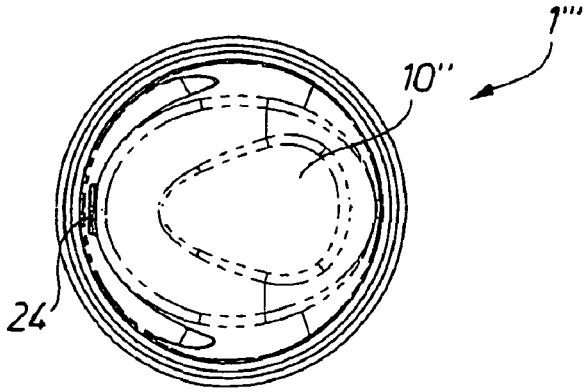

FIGS. 8-10 show various views of the dispenser pump 1'"—without the safety hood—to emphasize its slender and attractive external appearance. FIG. 8 shows an angled view from behind, FIG. 9 a side view, and FIG. 10 a top view.

The invention is not limited to the exemplary embodiments presented here. On the contrary, it can be realized in many different forms, provided that the basic idea of the invention, i.e., designing the suction chamber of the dispenser pump with a valve disk which performs a double function, is used.

| List of Reference Numbers | |
|---|---|
| 1, 1', 1", 1'" | dispenser pump |
| 2 | bottom opening of the discharge channel 3 |
| 3, 3', 3" | discharge channel |
| 4 | suction opening |
| 5 | container opening |
| 6, 6', 6" | lower pump part |
| 7 | valve disk |
| 8, 8', 8" | upper pump part |
| 9 | upper edge of 8 |
| 10, 10', 10" | hood |
| 11 | hinge |
| 12 | swinging cover |
| 13 | stop |
| 14, 14', 14" | suction chamber |

-continued

| List of Reference Numbers | |
|---|---|
| 15, 17, 19 | air hole |
| 16 | funnel |
| 18, 45 | safety cap |
| 21 | tube |
| 22 | corrugations in 7 |
| 23 | latch |
| 24 | applicator opening |
| 25 | outer edge of 7 |
| 26 | bottle, container |
| 28 | sealing pin |
| 29, 29' | ring bead |
| 32, 42 | ring piston |
| 33, 43 | restoring spring |
| 34 | annular space for 33 |
| 35 | intermediate collar |
| 36, 46 | upper profiling |
| 37, 47 | lower profiling |
| 38, 48 | ring-shaped web |
| 41, 41' | inner edge in the discharge channel |

The invention claimed is:

1. Dispenser pump (1, 1', 1", 1'") for the drip-free dispensing of metered amounts of liquid to paste-like products from containers such as bottles (26), canisters, or tubes, consisting of a lower pump part (6, 6', 6"), which is equipped with a suction opening (4) and is designed to be fastened in the opening of a container (5), where the suction opening (4) is brought into contact with the product by means of a tube (21); and an upper pump part (8, 8', 8") designed to draw the product through the suction opening (4) of the lower pump part (6) into a suction chamber (14, 14', 14") that has a changeable volume via a movable hood (10) or in the manner of a piston pump and to discharge the product from this suction chamber (14, 14', 14") through a discharge channel (3) with an applicator opening (24), wherein a one-piece, elastic valve disk (7), formed without through-openings , lies flat and unfastened on the suction opening (4) of the upper pump part (6, 6', 6") and thus forms the bottom end of the suction chamber (14, 14', 14") and provides a double function of an inlet valve and an outlet valve for the suction chamber;

the bottom opening (2) of lower discharge channel part (3') extends all the way down to the center of the valve disk (7); and wherein the center part of the valve disk (7) bulges up and down due to pressure changes in the suction chamber due to volume changes of the pressure chamber so that the disk alternately opens and closes the centrally located bottom opening (2) of the discharge channel part (3), whereas conversely the outer edge area (25) of the disk undergoes deformation simultaneously to close and open the suction opening (4) of the lower pump part (6, 6', 6").

2. Dispenser pump (1, 1', 1", 1'") according to claim 1, wherein the elastic valve disk (7) is made out of a thermoplastic elastomer.

3. Dispenser pump (1, 1', 1", 1'") according to claim 1, wherein the elastic valve disk (7) is made out of rubber.

4. Dispenser pump (1, 1', 1", 1'") according to claim 1, wherein the elastic valve disk (7) is designed with bellows-like corrugations (22) in its outer edge area (25).

5. Dispenser pump (1, 1', 1", 1'") according to claim 1, wherein a section of the upper discharge channel part (3") is angled, so that the applicator opening (24) can extend laterally out from the upper pump part (8, 8', 8").

6. Dispenser pump (1, 1') according to claim 1, wherein the upper pump part (8) is connected to the lower pump part (6) by the container (26), the lower pump part (6) is pressed into the container opening (5) to form a seal, the upper pump art (8) is connected to the container (26) by a force-fit or screw connection; the discharge channel (3) is a discharge tube (3), which is molded permanently into the upper pump part (8); and above the upper angled discharge channel part (3"), an axially deformable hood (10), made of a thermoplastic elastomer, is attached to an upper edge (9) of the upper pump part (8) to form a seal.

7. Dispenser pump (1, 1') according to claim 6, wherein a stop (13) is provided on the upper inside surface of the hood (10), above the angled dispenser channel part (3"), to limit the axial displacement of the hood (10) toward the angled discharge channel part (3").

8. Dispenser pump (1) according to claim 6, wherein an axially movable safety cap (18) is mounted on the upper pump part (8), where the movement of the cap in the outward direction is limited by ring beads (29, 29').

9. Dispenser pump (1') according to claim 6, wherein the upper pump part (8) is connected by a hinge (11) to a swinging cover (12).

10. Dispenser pump (1", 1'") according to claim 1, wherein the upper pump part (8', 8") is designed with freedom of axial movement with respect to the lower pump part (6, 6"), which surrounds the lower area of the upper pump part (8', 8"), so that the upper discharge channel part (3") and the hood (10', 10"), both of which are components of the upper pump part (8', 8"), are also free to move axially, the lower discharge channel part (3'), which is a component of the lower pump part (6', 6"), remains rigidly connected to the container and thus remains stationary together with the lower pump part when the pump is in use.

11. Dispenser pump (1", 1'") according to claim 10, wherein the suction chamber (14', 14") is designed in the manner of a piston pump as an annular space with a ring piston (32, 42), where the stationary annular space surrounds in circular fashion the lower discharge channel part (3'), wherein the ring piston (32, 42) is connected to the upper discharge channel part (3") and is free to slide back and forth inside the annular space over the lower discharge channel part (3').

12. Dispenser pump (1", 1'") according to claim 10, wherein a restoring spring (33, 43), which is supported against the lower pump part (6', 6"), is provided inside the upper pump part (8', 8") to return the axially movable upper pump part (8', 8") to its starting position upon completion of the dispensing process.

13. Dispenser pump (1") according to claim 12, wherein the restoring spring (33) is installed inside the discharge channel (3).

14. Dispenser pump (1'") according to claim 12, wherein the restoring spring (43) is installed outside the discharge channel (3) and the suction chamber (51).

* * * * *